US006990690B2

(12) United States Patent
Gait

(10) Patent No.: US 6,990,690 B2
(45) Date of Patent: Jan. 31, 2006

(54) LACROSSE GLOVE

(75) Inventor: Paul Gait, Syracuse, NY (US)

(73) Assignee: J. deBeer & Son, Inc., Altamont, NY (US)

( * ) Notice: Subject to any disclaimer, the term of this patent is extended or adjusted under 35 U.S.C. 154(b) by 0 days.

(21) Appl. No.: 10/798,518

(22) Filed: Mar. 11, 2004

(65) Prior Publication Data

US 2005/0273905 A1 Dec. 15, 2005

(51) Int. Cl.
*A41D 19/00* (2006.01)

(52) U.S. Cl. ..... 2/161.1

(58) Field of Classification Search ..... 2/16, 2/18, 19, 20, 158, 159, 160, 161.1, 162, 170
See application file for complete search history.

(56) References Cited

U.S. PATENT DOCUMENTS 3,911,497 A 10/1975 Lewis, Jr.
D257,909 S 1/1981 Brine
4,272,850 A 6/1981 Rule
4,484,359 A * 11/1984 Tirinen ..... 2/20
4,497,073 A 2/1985 Deutsch
4,524,464 A 6/1985 Primiano
4,541,127 A * 9/1985 Gould ..... 2/19
4,677,698 A 7/1987 Angas
4,815,147 A 3/1989 Gazzano
4,930,162 A 6/1990 Cote
5,088,123 A * 2/1992 MacDonald ..... 2/162
5,237,703 A 8/1993 Brine
5,367,712 A 11/1994 Smith
5,511,242 A 4/1996 Bianchi
5,511,243 A 4/1996 Hall
5,745,916 A 5/1998 Linner
5,819,312 A 10/1998 Snyder
5,884,329 A 3/1999 Goldsmith
5,946,720 A * 9/1999 Sauriol ..... 2/16
5,963,985 A 10/1999 Behr
5,983,396 A 11/1999 Morrow
5,996,117 A 12/1999 Goldsmith
6,122,769 A * 9/2000 Wilder et al. ..... 2/16

(Continued)

FOREIGN PATENT DOCUMENTS

CA 1222853 6/1987

*Primary Examiner*—Gary L. Welch
(74) *Attorney, Agent, or Firm*—Waddey & Patterson, P.C.; Edward D. Lanquist, Jr.; Phillip E. Walker

(57) ABSTRACT

A protective sports glove used to protect the fingers, the hand, the wrist, and at least a portion of the forearm of a user of the sports glove. The protective sports glove comprises a hand portion, including a palm section and a back section, a plurality of finger portions extending from the hand portion, a thumb portion extending from the hand portion proximate to the finger portions, and a cuff portion attached to the hand portion distal from the finger and thumb portions. The cuff portion includes a plurality of protection sections extending from the hand portion and aligned substantially parallel with a longitudinal axis of sports glove. The hand portion, finger portions, and thumb portion include multiple protective elements used to protect a user's hand, fingers, thumbs, and wrist from impact during participation in the sporting event.

25 Claims, 7 Drawing Sheets

U.S. PATENT DOCUMENTS

| | | | | |
|---|---|---|---|---|
| 6,226,795 | B1 | 5/2001 | Winningham | |
| 6,233,744 | B1 | 5/2001 | McDuff | |
| 6,256,792 | B1 | 7/2001 | MacDonald | |
| D446,888 | S | 8/2001 | Morrow | |
| D462,146 | S | 8/2002 | Aoki | |
| 6,543,057 | B2 | 4/2003 | Beland | |
| 6,550,069 | B1 | 4/2003 | Morrow | |
| 6,584,615 | B1 * | 7/2003 | Wilder et al. | 2/16 |
| 6,643,844 | B2 | 11/2003 | Morrow | |
| 2002/0069445 | A1 | 6/2002 | Beland | |
| 2003/0014805 | A1 | 1/2003 | Morrow | |
| 2003/0101504 | A1 | 6/2003 | Morrow | |
| 2003/0106131 | A1 | 6/2003 | Tremblay | |
| 2003/0163862 | A1 | 9/2003 | Hoffman | |
| 2003/0218344 | A1 | 11/2003 | Garrett | |

* cited by examiner

LACROSSE GLOVE

All patents and publications mentioned herein are hereby incorporated by reference in their entirety.

BACKGROUND OF THE INVENTION

The present invention relates generally to protective sports gloves, and more specifically, but without limitation, to a lacrosse glove having a cuff constructed and positioned to provide increased protection for a user of the glove.

Various protective sporting gloves have been developed over the years for use in lacrosse, hockey, and other similar contact sports. These gloves are designed protect the user of the glove, or player of the sport, against impacts and blows to their hands during participation in the sporting event. Unfortunately, as the protection provided by these gloves increases, the user of these prior art gloves experiences a reduction in the amount of flexibility he has in his hand due to the configuration of the glove. This reduction in flexibility can substantially reduce the effectiveness and level of play of a participant wearing the glove. Traditionally, however, as the level of flexibility allowed by a protective glove remains high, the protection provided by that glove has been limited. It is known in the art to provide a wrist guard on a sports glove to provide protection for participants' wrists between the cuff and hand portions of the glove. However, most of these prior art wrist guards limit the flexibility and therefore often removed by a user of the glove.

There are several areas of the hand that need to maintain an increased level of flexibility and yet still need a high level of protection. These areas include the various joints of the fingers and hand including the wrist. The wrist area can be especially problematic due to the high degree of flexibility within the wrist. For example, the hand can extend in the direction from the back of the forearm to the palm side of the forearm in a range of approximately 180°. This degree of rotation combined with the size of the wrist and forearm areas that need to be protected through this full range of motion presents increased problems.

For example, as the hand flexes towards the palm side of the forearm, any cuff located on the back of the glove will be drawn towards the hand and away from the forearm and wrist areas. Conversely, when the hand is flexed towards the back of the forearm, any cuff located underneath the glove will be pulled toward the hand and away from the palm side of the forearm. As such, a flexing of the hand at the wrist reduces the protective covering for the wrist and forearm.

Compounding this issue is the very padding located at the wrist and forearm areas. In order to sustain as complete of a range of motion as possible for the hand at the wrist, the padding or protection on the forearm and wrist should not substantially restrict the flexibility of the forearm, wrist and hand. Otherwise, the amount of the rotational range of the hand when flexed at the wrist will be limited due to the increased padding and protective materials in the glove.

In some instance, the configuration of the cuff itself limits the range of movement for the hand and the flexibility in the glove. For example, U.S. Pat. Nos. D462,146, 4,677,698, 4,497,073, 6,550,069, and 6,543,057 all disclose types of protective sports gloves in which the configuration of the glove limits range of movement of the hand at the wrist. In these prior art patents, the interaction between the cuff guard, wrist guard, hand guard, limits the range of movement of the hand at the wrist. This combined with the shape of the cuff on these gloves and the attachment of the individual elements of the cuff to one another substantially reduces the flexibility and range of motion of a wearer of the glove. As such, the users' ability to properly participate in the sport is limited.

What is needed then is a protective sports glove that provides adequate protection for the fingers, hand, wrist, and forearm of a user of the glove and still maintains a large range of motion for the various joints of the hand and wrist of a user of a glove.

This needed glove should protect a wearer of the glove from impacts from impacts from the equipment used within the game, such as hockey sticks, lacrosse sticks, pucks, balls, skates, and the like, as well was impacts between participants. This needed glove should provided substantial protection to the participants fingers, hands, wrists, and forearms while maintaining as much flexibility within the glove as possible. The flexibility is desired to allow the user to properly participate in the sport while the protection is required to reduce injury while participating in the sport.

BRIEF SUMMARY OF THE INVENTION

Disclosed herein is a protective sports glove used to protect the fingers, the hand, the wrist, and at least a portion of the forearm of a user of the protective sports glove. The protective sports glove comprises a hand portion, including a palm section and a back section, a plurality of finger portions extending from the hand portion, a thumb portion extending from the hand portion proximate to the finger portions, and a cuff portion attached to the hand portion distal from the finger and thumb portions. The cuff portion includes a plurality of protection sections extending from the hand portion and aligned substantially parallel with a longitudinal axis of sports glove. The hand portion, finger portions, and thumb portion include multiple protective elements used to protect a user's hand, fingers, thumbs, and wrist from impact during participation in the sporting event.

Also included is a protective sports glove comprising a back section, a palm section attached to the back section, and a cuff portion attached the back section. The back section includes a plurality of protective elements used to protect the hand of a user of the glove. The cuff includes a plurality of protection sections extending from the back section substantially parallel with the forearm of the user of the glove when the glove is worn by the user. The protection sections include a protection side having padding and protective elements. Each protection section also includes a flared end bent upward towards the protection side of the protection sections.

Also included is a wrist portion engaging the hand portion and the cuff portion. The wrist portion substantially covers the attachment between the hand portion and the cuff portion and facilitates in the protection of the user's wrist, while maintaining the flexibility in the wrist.

It is an object of the present invention to provide a sports glove to protect the hand, wrist, and forearm of a user of the glove during participation in the sport.

It is another object of the present invention to provide a sports glove that maintains the flexibility of the joints in the user's wrist and hand during participation of a sport while adequately protecting the fingers, hand, wrist, and forearm of a user of the glove.

Still another object of the present invention is to provide a protective glove that has a cuff comprised of elongated protection sections substantially aligned in an arcuate form.

It is another object of the present invention to provide a sports glove that has a cuff portion including protection sections and designed to allow a large range of motion in the hand of a user of the glove.

Another object of the current invention is to provide a protective sports glove that has multiple wrist and forearm protection section pivotally attached to allow independent movement and independent absorption of forces applied to the wrist and forearm areas.

Numerous other objects, features and advantages of the present invention will be readily apparent to those skilled in the art, upon a reading of the following disclosure, when taken in conjunction with the accompanying drawings.

BRIEF DESCRIPTION OF THE SEVERAL VIEWS OF THE DRAWINGS

FIG. 2 shows a user's hand approaching the glove for insertion.

FIG. 3 shows a user's hand inserted into the glove with a portion of the forearm extending out from underneath the cuff of the glove.

FIG. 4 shows the underside of the cuff portion that is nearest the skin of a user of a glove.

DETAILED DESCRIPTION OF THE INVENTION

Figure 1:
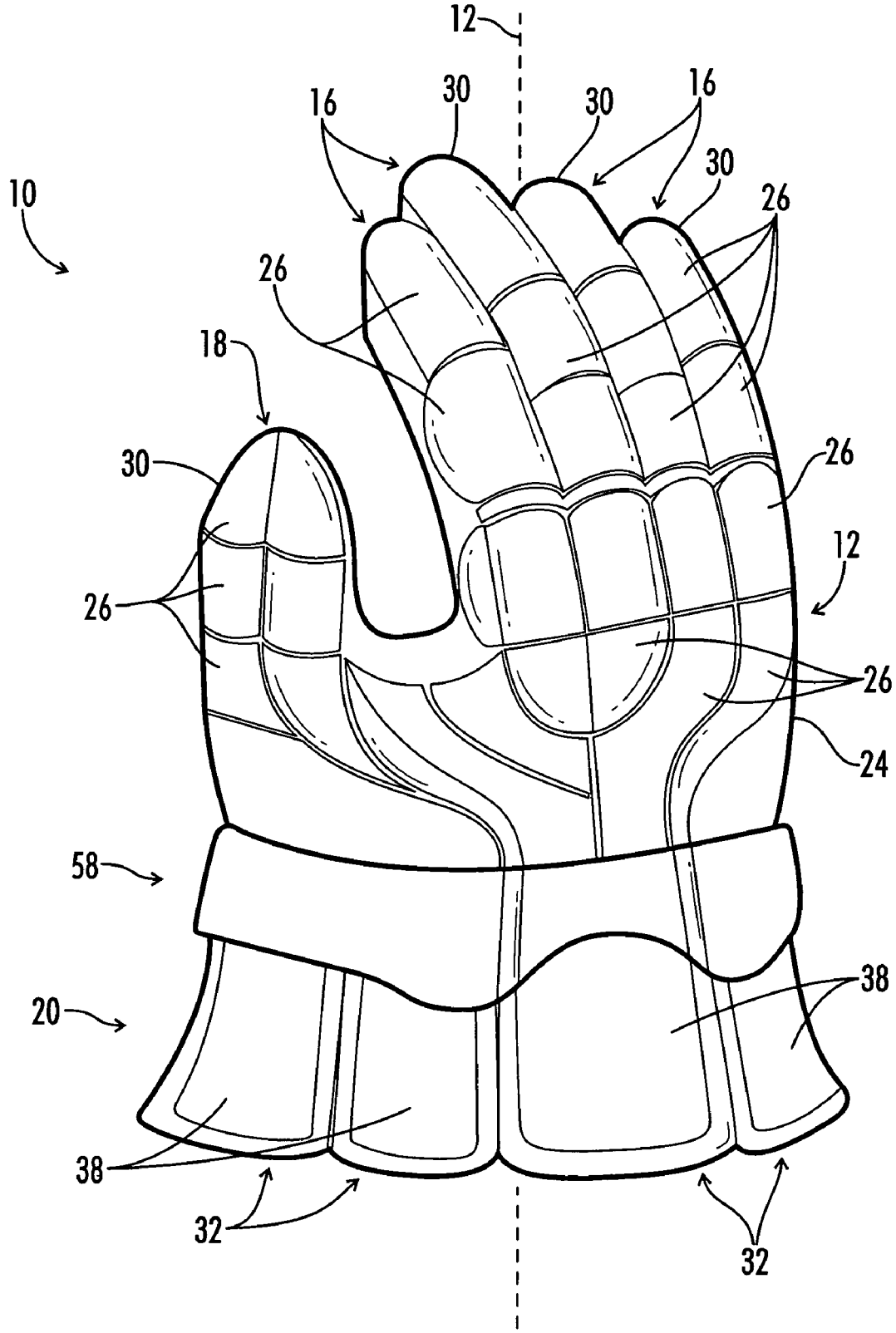
FIG. 1 is a perspective view of the back side of one embodiment of the glove of the current invention.

Referring generally now to FIGS. 1–8, a protective glove used in sports is shown and generally designated as the numeral 10. The protective glove 10 can be used in numerous sports, including lacrosse, hockey, and the like. The protective glove 10 includes a longitudinal axis 12 and comprises a hand portion 14, a plurality of finger portions 16, a thumb portion 18, and a cuff portion 20. The hand portion 14 includes a palm section 22 and a back section 24, while the plurality of finger portions 16 extend from the hand portion 14. The thumb portion 18 also extends from the hand portion 14 proximate to the location of the finger portions 16.

The back section 24 of the hand portion 14 includes a plurality of protective elements 26 positioned to protect the hand of a user of the protective glove 10 from impact. Each finger portion 16 and thumb portion 18 includes a grip section 28 and a back section 30. The back sections 30 also include a plurality of protective elements 26 positioned on the back sections 30 of the finger portions 16 and thumb portion 18 to protect a user of the glove 10 from impact. The protective elements 26 can be padding, plastic, rubber, leather, and other items and materials known in the art to provide protection from impact.

The cuff portion 20 is attached to the hand portion 14 distal from the attachment between finger portions 16 and thumb portion 18 to the hand portion 14. The cuff portion 20 includes a plurality of protection sections 32 extending from the hand portion 14 and aligned substantially parallel with the longitudinal axis 12.

Figure 2:
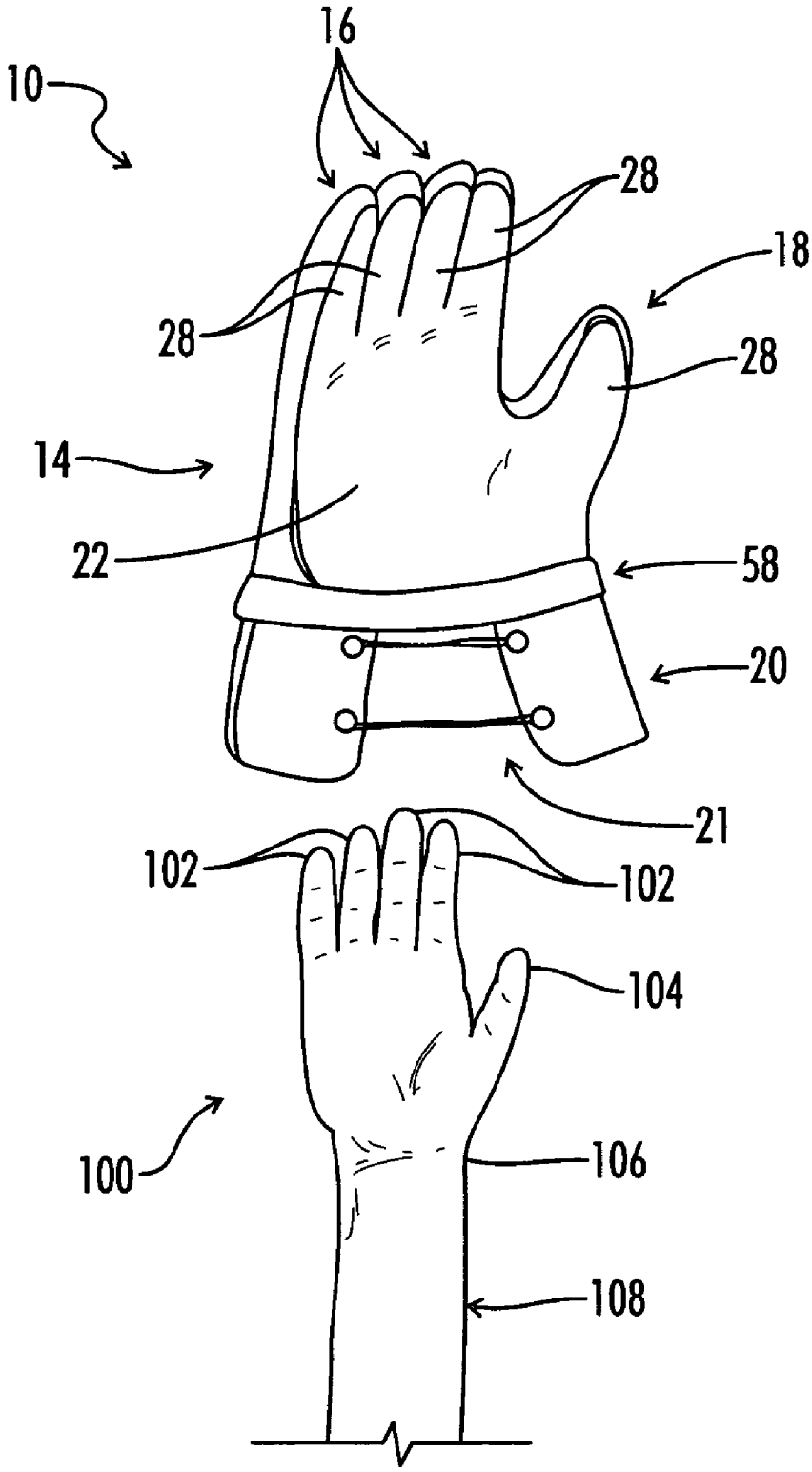
FIG. 2 is a perspective view of the palm side of one embodiment of the glove of the current invention.
Figure 3:
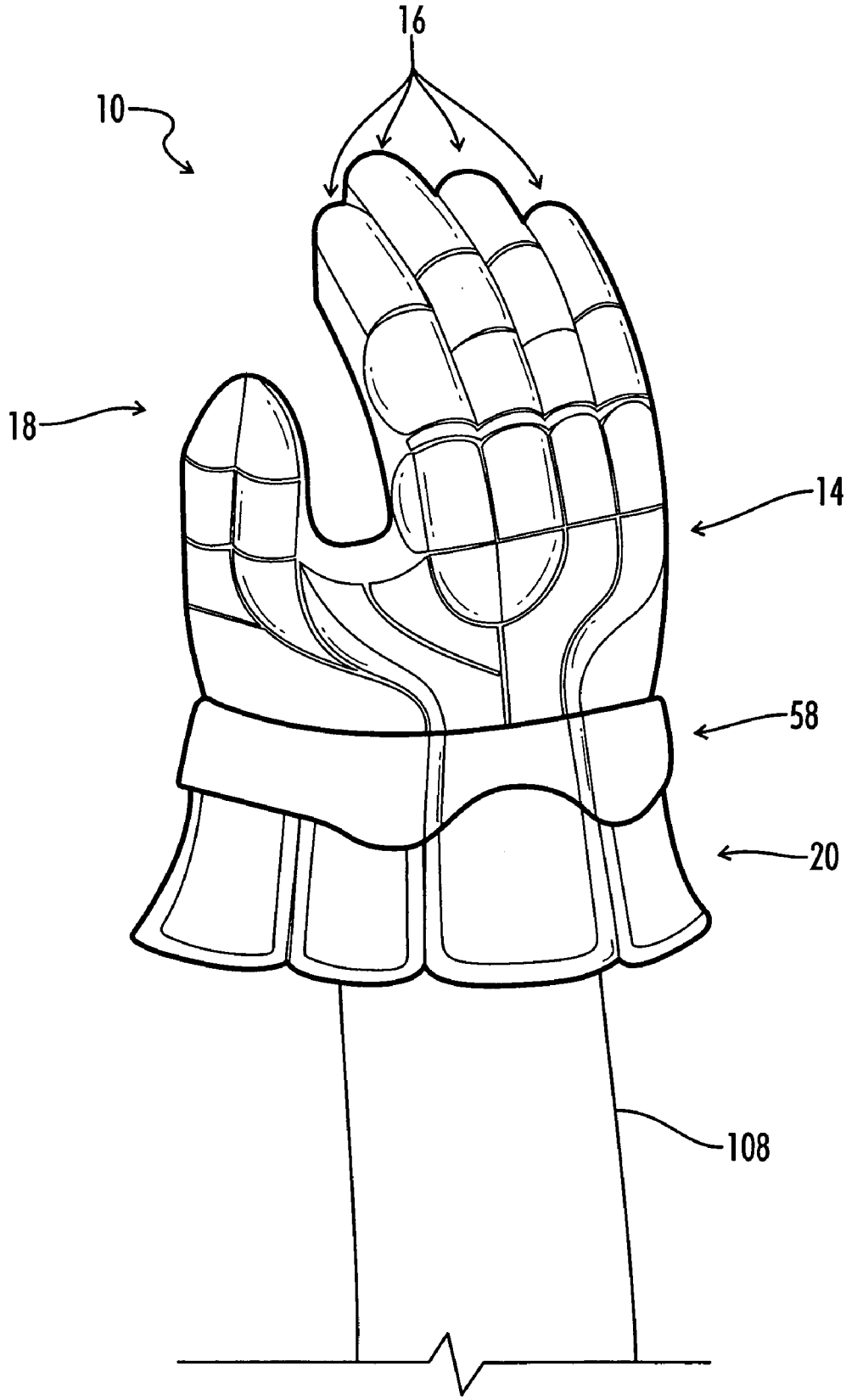
FIG. 3 is a perspective view of the protective side of one embodiment of the protective glove of the current invention.
Figure 4:
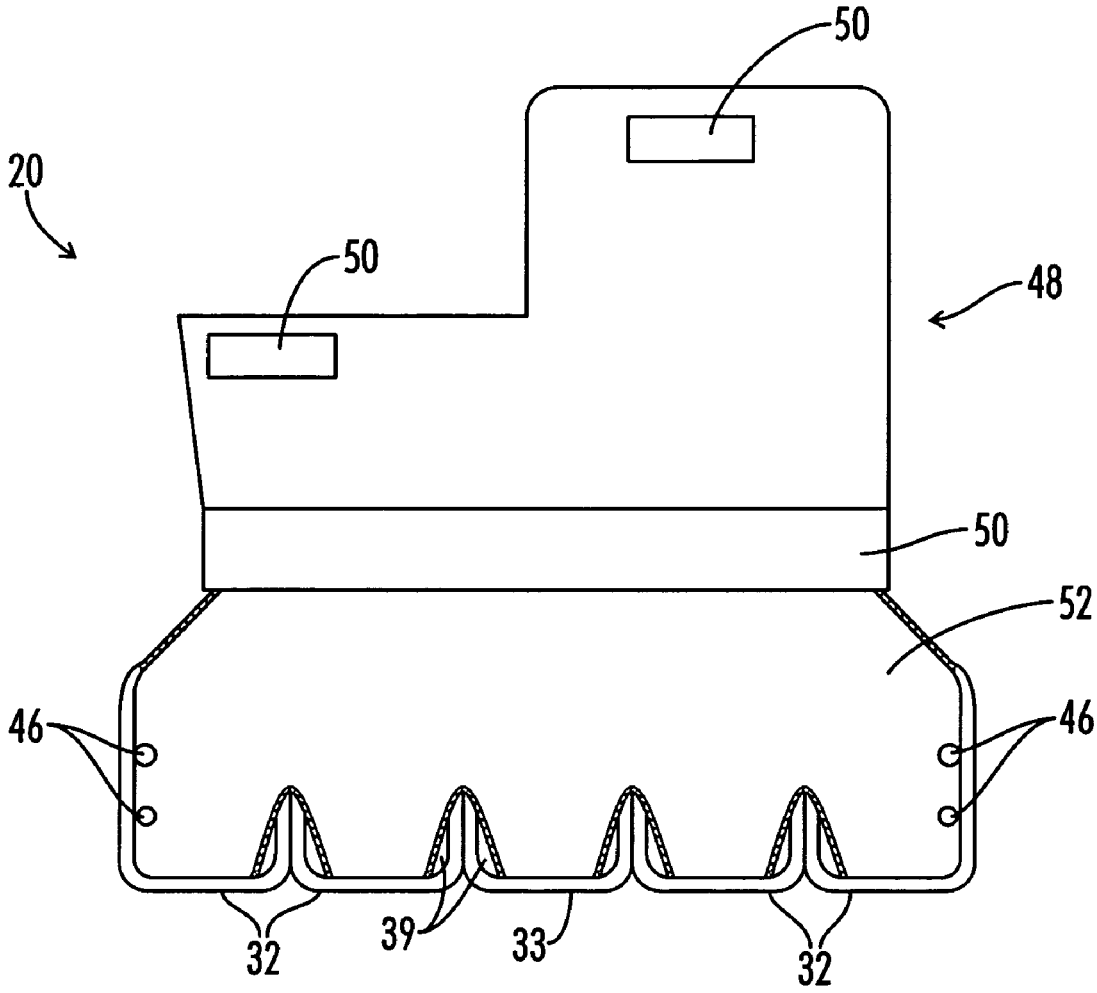
FIG. 4 shows one embodiment of the cuff portion of the glove.

As seen in FIGS. 2 and 3, a user's hand 100 can be inserted and protected by the glove 10. Specifically, a user's fingers 102, thumb 104, wrist 106, and forearm 108 can be protected by the glove 10. The protection for the user's forearm 108 is at least a partial protection of the lower part of the user's forearm 108 that is nearest the user's wrist 106.

The cuff portion 20 includes a cuff opening 21 between the end protection sections 32. The cuff opening 21 facilitates a full range of a user's hand 100 when the user wearing a glove 10.

In a preferred embodiment of the glove 10, the plurality of protection sections 32 are elongated in shape. Each protection section 32 includes a width 34 that increases as each protection section 32 extends away from the hand portion 14. This is best viewed in FIG. 7*a*. These protection sections 32 include sides 36 that are contoured and facilitate the expansion of the width 34.

Each protection section 32 also includes a protection side 38 and a flared end 40 bent towards the protection side 38. The flared end 40 facilitates flexibility within the glove by not restricting the range of movement of the hand at the wrist. This full range of movement is facilitated by the degree 41 of the bend located in the flared end 40 of each protection section 32. This can also be described as the distance 42 in which the flared end 40 raises off parallel with respect to the remainder of the protection section 32.

In a most preferred embodiment, the flared end starts to raise approximately half way along the length 44 of the flared end 40. Also, the distance 42 with which the flared end 40 raises with respect to the rest of the protection section 32 is approximately 25% of the overall length 44 of the elongated protection section 32.

Each protection section 32 is also attached to the adjacent protection sections 32. This attachment can be accomplished by various techniques, including, but not limited to, elastic, tied, Velcro®, snapped, and the like. The attachment can occur on the protection side 38 or the user's side 39 of each protection section 32. In a preferred embodiment each protection section 32 is elastically attached to each adjacent protection section 32. The plurality of protection sections 32 are arranged in an arc, or an arc like formation, to substantially conform to the shape of the forearm 108 of a user the glove 10. This formation substantially protects the top and sides of the user's forearm 108.

Figure 6A:
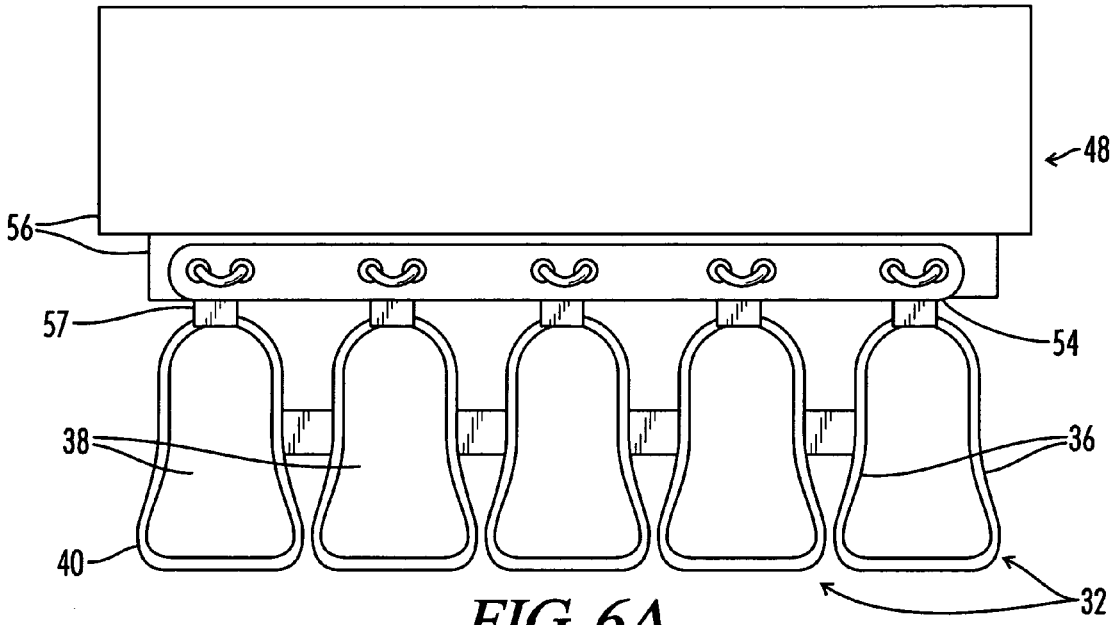
FIG. 6*a* shows an alternate embodiment of a subassembly of the cuff portion.
Figure 6B:
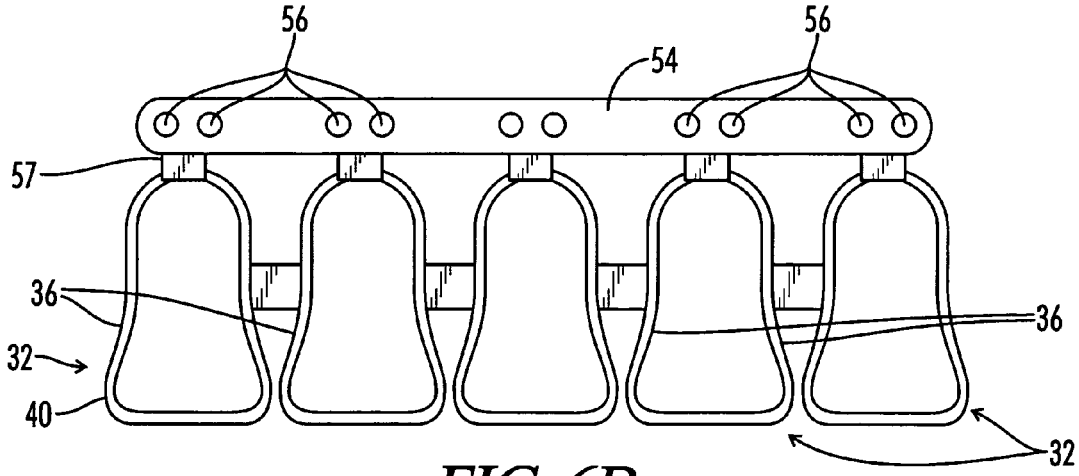
FIG. 6*b* shows a view of the subassembly similar to FIG. 6*a*.
Figure 7A:
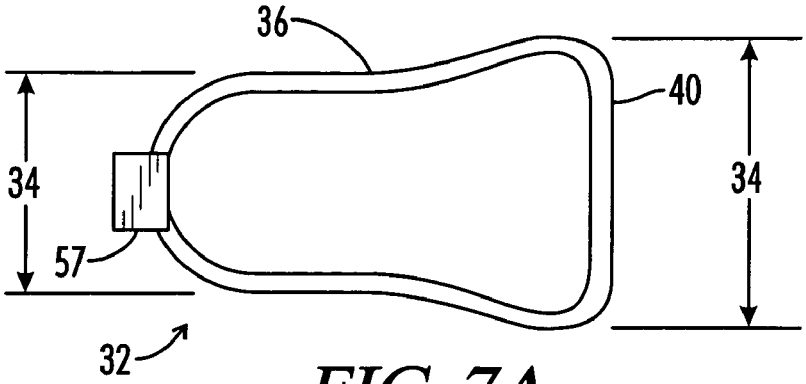
FIG. 7*a* shows a top view of one of the individual protection sections shown in FIG. 6*a* and FIG. 6*b*.
Figure 7B:
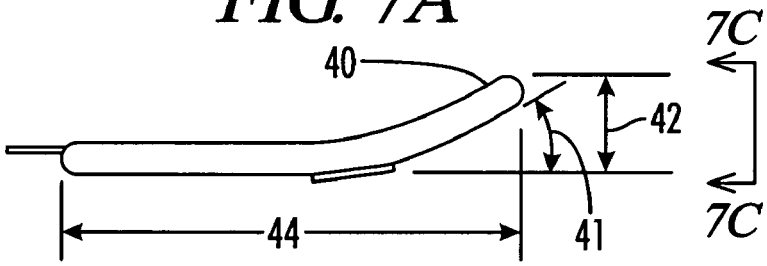
FIG. 7*b* shows a side view of the protection section shown in FIG. 7*a*.
Figure 7C:
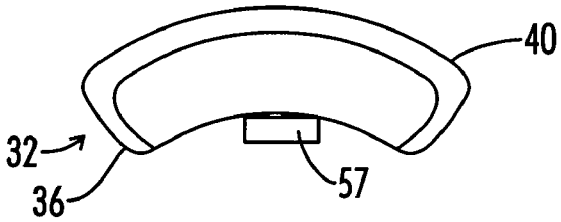
FIG. 7*c* shows an end view taken along lines 7*c* of FIG. 7*b*.
Figure 8:
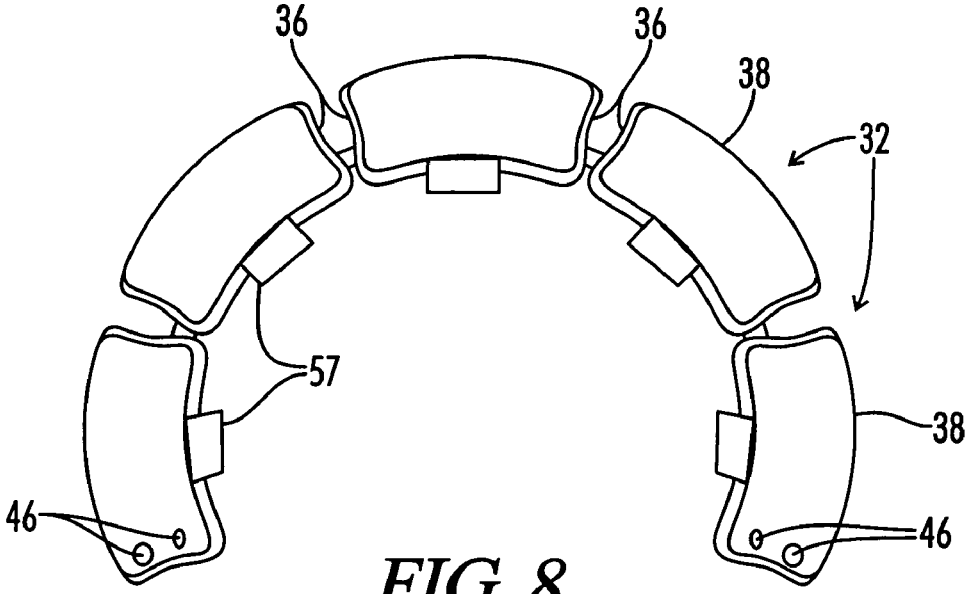
FIG. 8 shows the protection sections shown in FIGS. 6*a*–7*c* arranged in an arc like design.

The protection sections 32 can also include attachment apertures 46 used to facilitate attachment between the non-adjacent protection sections 32. This attachment between these non-adjacent protection sections 32 can be accomplished through numerous techniques, including, but not limited to, elastic, tied, Velcro®, snapped, stitched, and the like. In a preferred embodiment there are at least three protection sections, while in a more preferred embodiment there are four protection sections, while in a most preferred embodiment there are five protection sections that are "bell-shaped" as seen in FIGS. 6A–6B.

The cuff portion 20 also includes an intermediary section 48 connecting the elongated protection section 32 to the hand portion 14. The intermediary section 48 includes at least one attachment location 50 used to attach the intermediary section to the hand portion 14. This attachment location can include the use of adhesives, Velcro®, snaps, elastic, tied, stitched, and the like, to secure the cuff portion to the hand portion 14. The intermediary section 48 includes a liner 52 used to facilitate connection between the elongated protection sections 32 and the intermediary section 48. The liner 52 can be of any material suitable for a liner known in the art, but preferably comprises spandex.

In an alternate embodiment, the intermediary section 48 includes a connection strip 54 with openings 56 to attach the elongated protection section 32 to the intermediary section 48. The protection sections 32 can be attached through fasteners 57 to the openings 56 and the connection strip 54, then to the intermediary section 48. The fasteners 57 can be several items and techniques known in the art, including, but not limited to snaps, tied fabric, elastic, and the like.

In a most preferred embodiment a centrally located protection section 33 has an increased width 34' with the respect to the widths 34 of the remaining protection sections 32. This wider protection section 33 can be designed to be centrally located on the top portion of a user's forearm 108 when the user is wearing the glove 10 to provide additional protection in an area of potentially increased impact.

The glove 10 further includes a wrist portion 58 engaging the hand portion 14 and the cuff portion 20. The wrist portion 58 substantially covers the attachment between the hand portion 14 and the cuff portion 20 and facilitates protecting the junction between the hand portion 14 and the cuff portion 20. The wrist portion can have multiple protective elements 26 positioned along its outer surface to protect a wearer of the glove 10 from impacts. The positioning and spacing between the multiple protective elements 26 on the wrist portion 58 facilitates the maintenance of a substantial level of flexibility in the wrist.

Figure 5A:
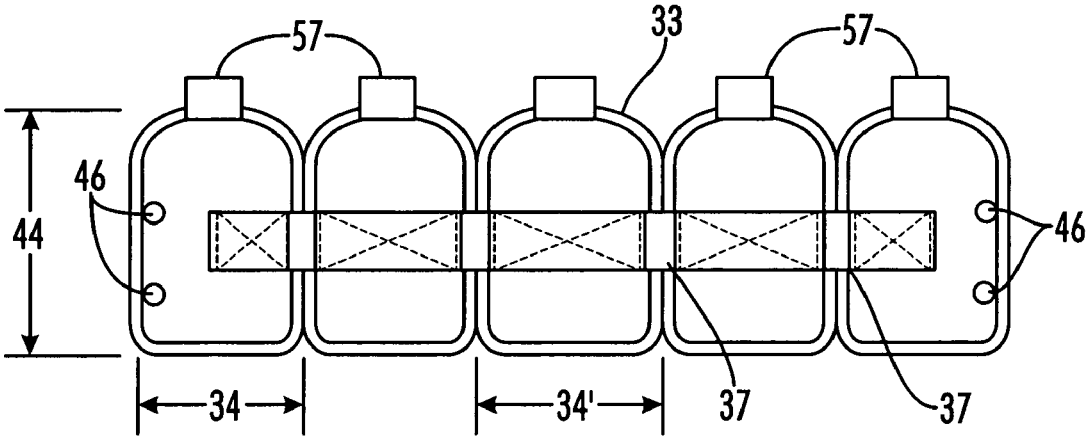
FIG. 5*a* shows a view of one embodiment of the protection sections attached to one another.
Figure 5B:
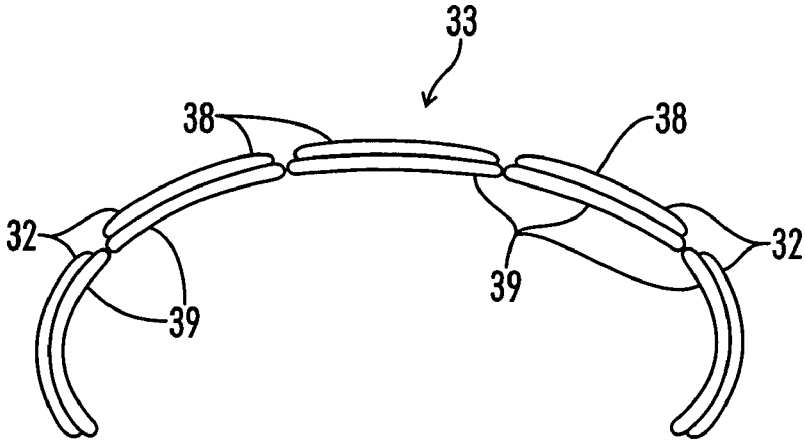
FIG. 5*b* shows the protection sections of FIG. 5*a* arranged in an arc like alignment.

In an alternate embodiment, each protection section 32 includes at least one side 36 that is coterminous with at least one side 36 of an adjacent protection section 32. This relationship is best illustrated in FIG. 5A. Preferably, this coterminous relationship extends along a majority of the length 44 of the protection section 32.

The protection sections 32 are pivotally attached to adjacent protection sections 32 by pivot attachments 37. The pivot attachments 32 allow independent movement of one protection section 32 relative to adjacent protection sections 32. The pivotal attachment facilitates the reduction in movement of adjacent protection sections 32 when a single protection section 32 absorbs an impact, or contact, during participation in the sporting event. In a preferred embodiment, the pivotal attachment is a flexible attachment accomplished through elastic. However, other forms of pivotal attachment can be used.

Alternately, the glove 10 can be described a glove protecting the hand 100, wrist 106 and forearm 108 of a user of the glove 10. The glove 10 comprises a back section 20 that includes a plurality of protective elements 26, a palm section 22 attached to the back section 24, and a cuff portion 20 attached the back section 24. The cuff portion 20 includes a plurality of the protection sections 32 extending from the back section 24 substantially parallel with the forearm 108 of the user.

Also, the plurality of the protection sections 32 are arcuately aligned to substantially conform to the shape of the forearm 108 of the user. This alignment along with the configuration of the protection sections 32 facilitates protection of the wrist 106 and forearm 108 of the user of the glove 10.

Thus, although there have been described particular embodiments of the present invention of a new and useful Lacrosse Glove, it is not intended that such references be construed as limitations upon the scope of this invention except as set forth in the following claims.

What is claimed is:

1. A protective sports glove having a longitudinal axis, the protective sports glove comprising:

a hand portion including a palm section and a back section;

a plurality of finger portions extending from the hand portion;

a thumb portion extending from the hand portion proximate the finger portions; and a cuff portion attached to the hand portion distal from the finger and thumb portions, the cuff portion including a plurality of protection sections extending from the hand portion and aligned substantially parallel with the longitudinal axis: and wherein each protection section includes a radial path to the longitudinal axis unobstructed by adjacent protection sections.

2. The protective sports glove of claim 1, wherein each protection section includes a width whereby the width increases as each protection section extends away from the hand portion.

3. The protective sports glove of claim 2, wherein substantially the entire width of each protection section includes contoured sides the unobstructed radial path to the longitudinal axis.

4. The protective sports glove of claim 1, wherein:

each protection section includes a length and a plurality of sides; and at least one side of each protection section is coterminous with at least one side of an adjacent protection section.

5. The protective sports glove of claim 4, wherein at least one side of each protection section is coterminous with at least one side of an adjacent protection section along a majority of the length of each protection section.

6. The protective sports glove of claim 5, wherein each protection section is pivotally attached to the adjacent protection section at a point alone the length of each protection section.

7. The protective sports glove of claim 6, wherein the each protection section is elastically attached to each adjacent protection section.

8. The protective sports glove of claim 6, wherein the plurality of protection sections is arcuately aligned.

9. The protective sports glove of claim 1, wherein each protection section includes a protection side and a flared end bent toward the protection side.

10. The protective sports glove of claim 1, further including:

a wrist portion engaging the hand portion and the cuff portion, the wrist portion substantially covering the attachment between the hand portion and the cuff portion;

wherein the back section of the hand portion includes a plurality of protective elements; and wherein each of the finger portions includes a grip section and a back section, the back section including a plurality of protective elements.

11. A protective sports glove for protecting the hand, wrist and forearm of a user, the protective sports glove comprising:

a back section including a plurality of protective elements;

a palm section attached to the back section; and a cuff portion attached to the back section and positioned substantially parallel with the forearm of a user of the glove when in worn, the cuff portion including a plurality of protection sections extending from the back section, wherein each protection section is pivotally joined to at least one adjacent protection section.

12. The protective sports glove of claim 11, wherein the plurality of protection sections is arcuately aligned.

13. The protective sports glove of claim 12, wherein the plurality of protection sections substantially conforms to the shape of the forearm of the user.

14. The protective sports glove of claim 11, wherein the protection sections are elongated in shape.

15. The protective sports glove of claim 11, wherein each protection section includes a protection side and a flared end bent toward the protection side.

16. The protective sports glove of claim 15, wherein each protection section includes a width whereby the width increases as each protection section extends away from the hand portion.

17. The protective sports glove of claim 15, wherein each protection section is substantially bell shaped.

18. A protective sports glove for protecting the hand, wrist and forearm of a user, the protective sports glove comprising:

a hand portion including a palm side;

a plurality of finger portions extending from the hand portion;

a thumb portion extending from the hand portion proximate the finger portions, wherein the hand portion, the finger portions and the thumb portion each include a back side having a plurality of protective elements; and a cuff portion attached to the hand portion distal from the finger and thumb portions, the cuff portion including a plurality of protection sections extending from the hand portion opposite the finger portions, wherein each protection section is pivotally attached to at least one adjacent protection section to allow independent deflection of each protection section relative to the adjacent protection section.

19. The protective sports glove of claim 18, wherein each protection section includes a protection side and a flared end bent toward the protection side.

20. The protective sports glove of claim 18, wherein each protection section includes a width whereby the width increases as each protection section extends away from the hand portion.

21. The protective sports glove of claim 18, wherein each protection section is elongated and is pivotally attached to at least one adjacent protection section in a substantially arcuate alignment.

22. The protective sports glove of claim 18, wherein there are four protection sections.

23. The protective sports glove of claim 18, wherein the protection sections are bell-shaped.

24. The protective sports glove of claim 18, further including a wrist portion engaging the hand portion and the cuff portion and substantially covering the attachment between the hand portion and the cuff portion.

25. The protective sports glove of claim 18, wherein each protection section is aligned substantially parallel with the forearm of the user.

* * * * *